US005332111A

United States Patent [19]

Bowen

[11] Patent Number: 5,332,111

[45] Date of Patent: Jul. 26, 1994

[54] BOTTLE THAT FUNCTIONS UPRIGHT AND INVERTED USING THE SIDES OF THE BOTTLE FOR SUPPORT

[76] Inventor: John H. Bowen, 3345 Westhaven Ct., Eau Claire, Wis. 54701

[21] Appl. No.: 109,911

[22] Filed: Aug. 23, 1993

[51] Int. Cl.[5] ..... B65D 23/12

[52] U.S. Cl. ..... 215/100 R; 222/184; 248/311.3

[58] Field of Search ..... 248/311.3; 222/181, 222/184, 185; 215/100 R

[56] References Cited

U.S. PATENT DOCUMENTS

| | | | |
|---|---|---|---|
| 3,325,030 | 6/1967 | Rausing et al. | 222/184 X |
| 3,402,844 | 9/1968 | Chin | 215/100 R X |
| 4,271,878 | 6/1981 | Bologa | 248/311.3 X |
| 4,669,621 | 6/1987 | Steigerwald et al. | 215/100 R X |
| 4,723,671 | 2/1988 | Mears | 215/228 |
| 4,747,496 | 5/1988 | Rendine | 215/100 R X |
| 4,869,382 | 9/1989 | Thompson | 215/100 R X |
| 4,984,723 | 1/1991 | Hsu | 215/100 R X |
| 5,065,966 | 11/1991 | Hartke | 248/311.3 X |
| 5,088,673 | 2/1992 | Chandler | 215/100 R X |
| 5,149,041 | 9/1992 | Hartke | 248/311.3 X |

FOREIGN PATENT DOCUMENTS

| | | | |
|---|---|---|---|
| 534111 | 12/1954 | Belgium | 215/100 R |

*Primary Examiner*—Allan N. Shoap
*Assistant Examiner*—Christopher McDonald

[57] ABSTRACT

A bottle uses a sleeve to stabilize it when in the inverted position. The sleeve in normally around the middle of the bottle when the bottle is upright. The bottle has a lock for the sleeve which is a thickened area of the bottle sidewall. When one wishes to invert the bottle, the lock is pushed inwardly and the sleeve is slid upward over the lock and its top edge is above the bottle top. The top edge is what provides a stable base to support the bottle when it is inverted. The sleeve is maintained in this extended position by the lock pressing against the sleeve due to the resiliency of the bottle.

5 Claims, 3 Drawing Sheets

BOTTLE THAT FUNCTIONS UPRIGHT AND INVERTED USING THE SIDES OF THE BOTTLE FOR SUPPORT

BACKGROUND OF THE INVENTION

1. Field of the invention

The invention relates to a bottle that is stable in both the upright and inverted position. A sleeve around the bottle supports and stabilizes the bottle when it is inverted, allowing the contents to collect near the opening at the top.

2. Description of the Prior Art

When a bottle of viscous liquid is more than half empty it is sometimes a problem to get the contents out of the bottle. Viscous liquid has a tendency to cling to the sides of the bottle and takes a long time to reach the opening. This often necessitates the shaking and pounding of the bottle to get the liquid to move quicker.

There have been previous attempts to solve this problem. Most use the cap or a series of caps to solve the problem. Others use metering devices and are expensive to make and maintain.

SUMMARY OF THE INVENTION

The invention uses a sleeve that is normally around the body of the bottle. This sleeve can be slid upward so that the top of the sleeve is level with or above the opening in the top of the bottle. The top of the sleeve then serves to stabilize the bottle when it is inverted.

It is the primary object of the invention to have a simple, lightweight bottle that can be safely stored in the upright or inverted position.

Another object of the invention is to have an invertible bottle that can use any type of cap such as screw on, pop-up or flip open.

It is a further object of the invention to provide a bottle that is not expensive to manufacture.

DETAILED DESCRIPTION OF THE PREFERRED EMBODIMENT

Figure 4:
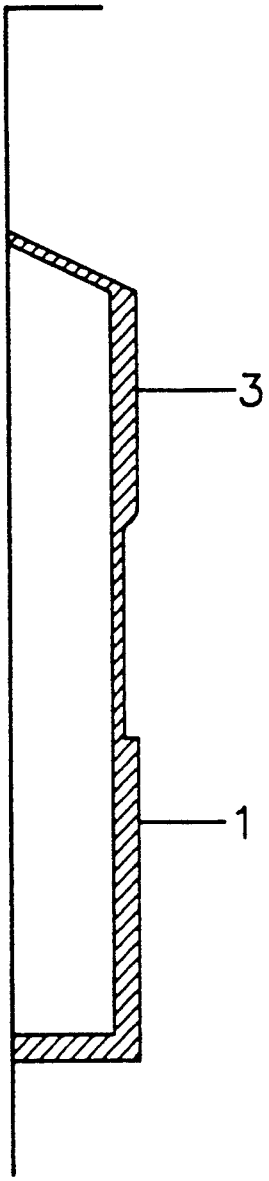
FIG. 4 is a view along line 4—4 of FIG. 3.
Figure 5:
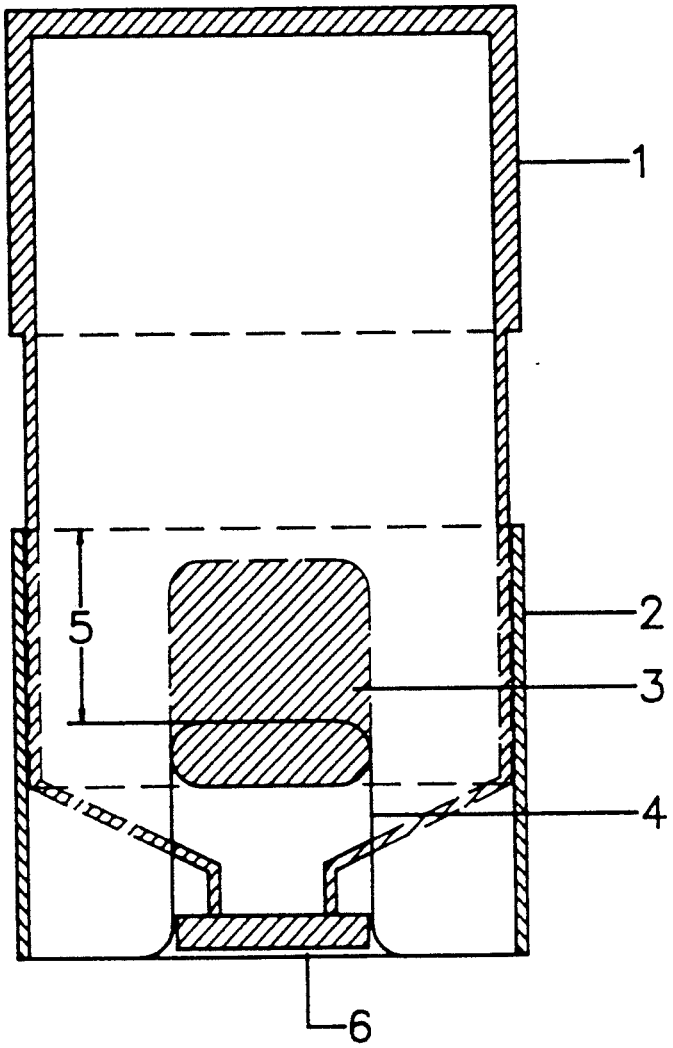
FIG. 5 is a view of the inverted bottle with the sleeve extended and locked.

The preferred embodiment of the invention consists of a bottle 1 which has an opening in its top. The top half of the bottle has a sidewall of reduced thickness. The top half of the bottle also has an area of increased thickness 3 that serves as a lock. As can be seen from FIG. 4, this lock extends to the inwardly sloping wall of the bottle top.

Figure 1:
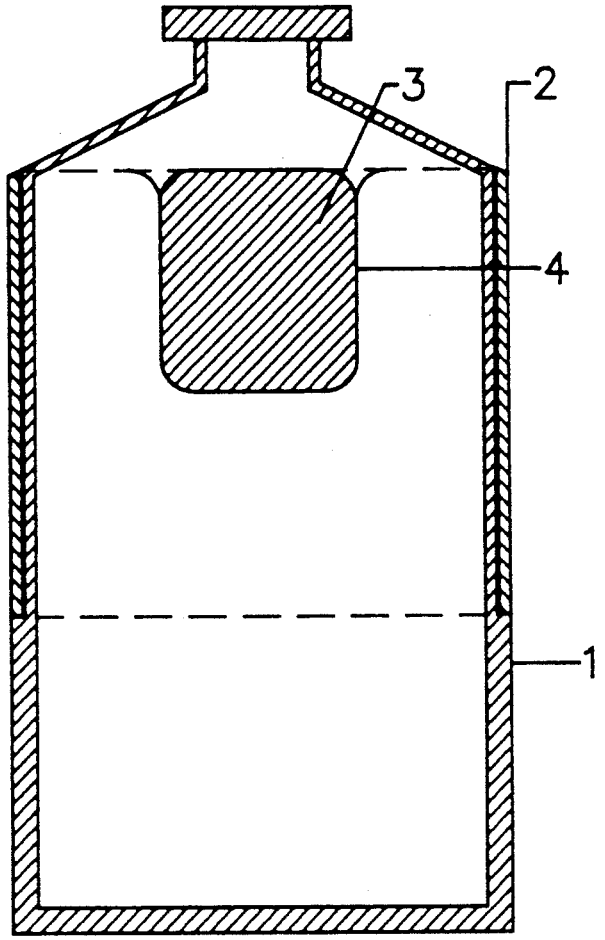
FIG. 1 shows a cross sectional view of the bottle in the upright position with the sleeve in the retracted position.
Figure 2:
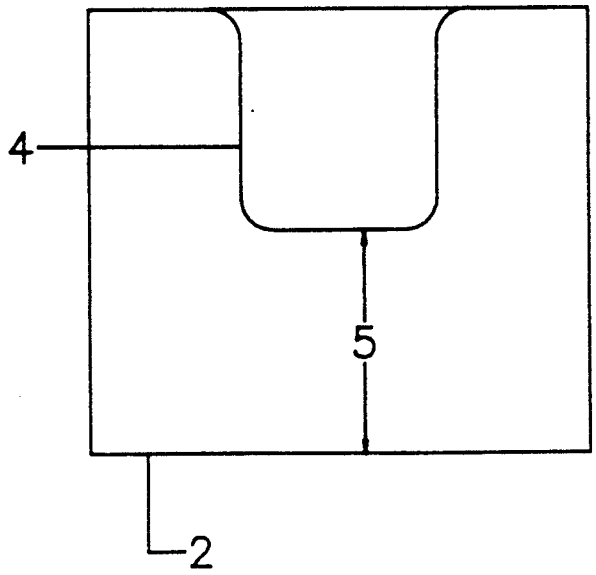
FIG. 2 shows the sleeve alone.
Figure 3:
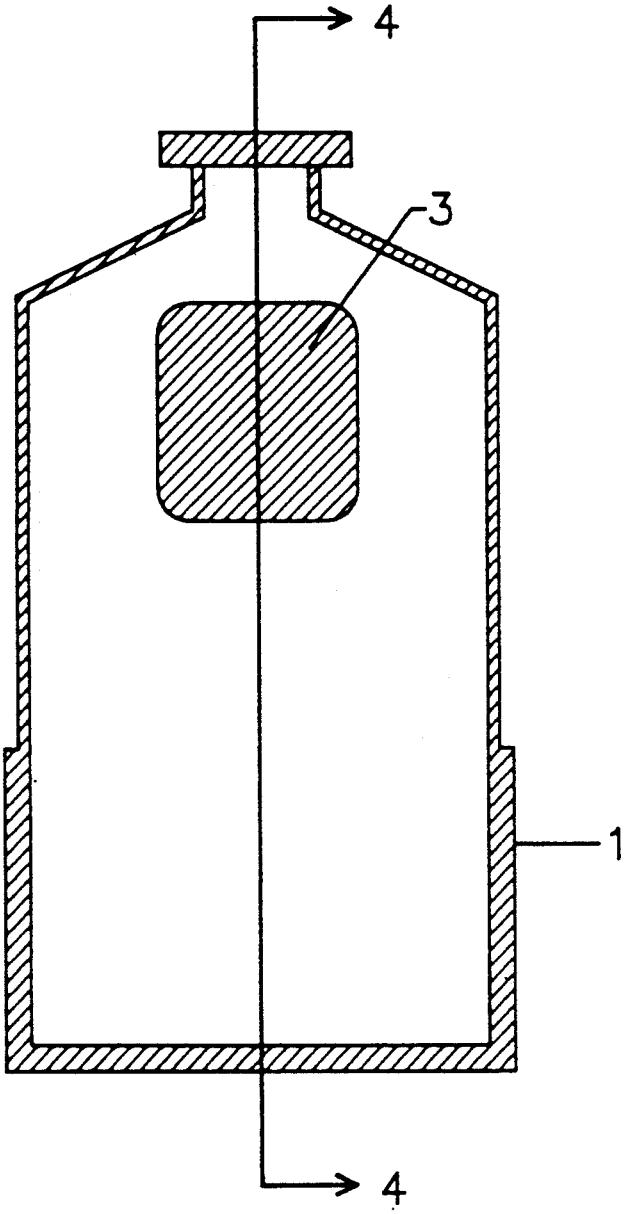
FIG. 3 shows the bottle without the sleeve.

A sleeve 2 encircles the bottle about the area of reduced thickness. The thickness of the sleeve is equal to the amount by which the sidewall has been reduced. This results in a flush joint between the bottom of the sleeve and the bottle half of the bottle as is illustrated in FIG. 2. The sleeve has a cutout 4 which extends from the top edge of the sleeve. This cutout is the same size and shape as the lock and in the retracted position, the lock fits into the cutout.

When one wishes to put the sleeve in the extended position, the lock is pushed in a sufficient amount by the application of pressure to allow the sleeve to move upward. When the sleeve is level or above the cap of the bottle, the top edge provides a stable base for the bottle when it is in the inverted position. The sleeve is held in the extended position by the lock. When the pressure on the lock is relieved the resiliency of the bottle causes the bottle to resume its normal shape. This causes the lock to push against the part of the sleeve which is now over it. The cut out allows access to the bottle cap even when the sleeve is in the extended position.

Although the present invention has been described and illustrated with respect to a preferred embodiment and a preferred use therefor, it is not to be so limited since modifications and changes can be made therein which are within the full intended scope of the invention.

I claim:

1. A system for maintaining a bottle in an inverted position comprising:

a bottle having a top, a bottom and a sidewall therebeteen, said bottle having a slidable sleeve about said sidewall, said sleeve having a top portion with a peripheral edge, said sleeve slidable from a normal position between said top and bottom to an extended position in which said top portion edge extends above the bottle top, said bottle and sleeve including means for locking the bottle to the sleeve in said extended position, said means including a projection on said sidewall formed by an area of increased wall thickness relative to the surrounding area of the bottle, said means further including a cutout in the sleeve, said cutout surrounding the projection in the normal position and said projection pressing against the sleeve in the extended position.

2. The system of claim 1 wherein:

said cutout extends from the top edge of the sleeve.

3. The system of claim 1 wherein:

the cutout is substantially the same size and shape as the lock.

4. The system of claim 1 wherein:

the sleeve encircles the bottle about an area of reduced thickness so that the sleeve is flush with the remaining portion of the bottle.

5. The system of claim 1 wherein;

the bottle is round.

* * * * *